US005936493A

United States Patent [19]

Hulderman et al.

[11] Patent Number: 5,936,493

[45] Date of Patent: Aug. 10, 1999

[54] LOW COST, ONE-SHOT SWITCH WAVEGUIDE WINDOW

[75] Inventors: Garry N. Hulderman, Riverside; Richard J. Swanson, Corona, both of Calif.

[73] Assignee: Raytheon Company, Lexington, Mass.

[21] Appl. No.: 08/977,388

[22] Filed: Nov. 24, 1997

[51] Int. Cl.[6] ..... H01P 1/08; H01P 1/10

[52] U.S. Cl. ..... 333/252; 333/258; 333/99 R

[58] Field of Search ..... 333/13, 101, 252, 333/258, 99 R; 337/161, 164, 229, 293

[56] References Cited

U.S. PATENT DOCUMENTS

| | | | |
|---|---|---|---|
| 2,934,627 | 4/1960 | Bristol et al. | 337/293 |
| 3,979,703 | 9/1976 | Craven | 333/258 |
| 4,473,806 | 9/1984 | Johnston | 333/101 |
| 5,055,805 | 10/1991 | Kan | 333/258 X |

FOREIGN PATENT DOCUMENTS

| | | | |
|---|---|---|---|
| 3534980 | 4/1987 | Germany | 333/258 |
| 5-274994 | 10/1993 | Japan | 337/161 |

*Primary Examiner*—Paul Gensler
*Attorney, Agent, or Firm*—David W. Collins; Andrew J. Rudd; Glenn H. Lenzen, Jr.

[57] ABSTRACT

Inexpensive and reliable apparatus for blanking the signal path between an antenna and a transmitter or a receiver to protect them from harmful radiation in the absence of power forms supplied thereto. The apparatus is preferably formed as a printed circuit waveguide switch window having a plurality of parallel conductors, such as metal wires or printed circuit traces, disposed on a dielectric substrate. The waveguide switch window is secured between two sections of waveguide. The conductors have a predetermined separation and width that are designed to appear as a solid metal surface that rejects radiation over a wide bandwidth. A bias terminal is coupled to the plurality of conductors, and insulating material is disposed between the bias terminal and the conductors to insulate the top portion of the grid array from the adjacent waveguide. The lower portion of the grid array is grounded to the adjacent waveguide. When the waveguide switch window is in its protective, blanked state, it blocks undesired radiation from entering the antenna and destroying sensitive components in the receiver. When a predetermined voltage is supplied to the bias terminal, it vaporizes the grid array and opens the waveguide switch window to allow normal operation of the antenna and receiver. As proven by tests, the waveguide switch window provides radiation immunity against high level input radiation power and high isolation (30 dB) for receiver protection in the blanked state, and with no measurable loss in the unblanked state.

20 Claims, 1 Drawing Sheet

LOW COST, ONE-SHOT SWITCH WAVEGUIDE WINDOW

BACKGROUND

The present invention relates generally to waveguide switches, and more particularly, to a low cost printed circuit waveguide switch window.

Prior art waveguide switches typically include one or more of the following components: semiconductors, moving parts, and/or ferrite materials. Some of the disadvantages of these prior art switches include higher cost, vulnerability to input power, lower isolation, and higher loss. A search was performed regarding to the present invention and a number of United States patents were uncovered that disclose various types of waveguide-related windows.

U.S. Pat. No. 5,279,156 entitled "Distance measuring device especially for measuring the fill level in industrial tanks", discloses a distance measuring device for measuring the fill level in industrial tanks, which includes electronic transmitting and receiving elements for short wave electromagnetic waves, such as microwaves, and a cylindrical waveguide which extends through a separating wall and inside of which is a waveguide window separating the two spaces and made of a material, such as quartz glass, which is transmissive with respect to electromagnetic waves. The waveguide and the waveguide window have conically-shaped sections to provide axial support. To protect the waveguide window against destruction due to thermal expansions and pressure fluctuations, the conical section of the waveguide window is in a correspondingly formed conical socket. The socket is mounted with play in a cylindrical bore of the waveguide window and is supported by a shoulder of the waveguide in the axial direction. For support in both longitudinal directions, two waveguide windows, each with one socket, are arranged in a mirror image configuration, and the waveguide is divided into two detachably joined sections so that when open, the sockets and the waveguide windows can be placed into the cylindrical bores of the sections.

U.S. Pat. No. 5,043,629 entitled "Slotted dielectric-lined waveguide couplers and windows" discloses that dielectric-filled longitudinal slots in the common wall of concentric circular and coaxial dielectric-lined waveguides allow microwave energy to be efficiently coupled therethrough. Such couplers are used with megawatt level gyrotrons for varied applications. One application provides a double seal waveguide vacuum window with low reflections over a wideband of frequencies. Another application provides an output coupler and window for quasi-optical gyrotrons. Still another application provides a waveguide mode converter for converting high order microwave modes, as are commonly found in waveguide cavities of high power gyrotrons, to lower-order modes suitable for low-loss transmission, such as the $HE_{11}$ mode.

U.S. Pat. No. 4,032,868 entitled "Multimodal high pressure waveguide window" discloses multimode waveguide window which provides an RF connection through a metal barrier such as the hull of a submarine. RF transmission is effected with a minimum of insertion loss and the structure is capable of withstanding hydrostatic pressures up to 1000 psi. In the event that the incoming waveguide structure is accidentally severed from the ship, the window provides a watertight seal.

U.S. Pat. No. 5,450,047 entitled "High power waveguide window and waveguide assembly" discloses a waveguide window for use in high power waveguide applications. The window preferably includes a thin sheet of dielectric material having a first planar face, a second face, and a support structure attached to the first face to provide mechanical support for the sheet. The support structure preferably includes a plurality of parallel conductive support bars, each bar having an inner portion attached to the first face and an outer portion extending away from the sheet, the outer portion being tapered to minimize wave reflection. At least one bar also has a channel bored therethrough to allow a coolant to flow through the bar to remove heat generated within the dielectric sheet. Together, the sheet and the support structure form a waveguide window which may be used to environmentally separate one waveguide section from another. The waveguide window preserves the particular environments of each section while allowing electromagnetic waves to propagate from one section to the other.

U.S. Pat. No. 4,688,009 entitled "Triple-pane waveguide window" discloses a waveguide window containing a central transverse pane of a material with high dielectric constant such as alumina ceramic. The central pane is an integral number of half-wavelengths thick. On each side of the central pane and immediately adjacent it is a side pane of material with relatively low dielectric constant such as fused quartz. The side panes are odd numbers of quarter-wavelengths thick. The dielectric constants of the side panes are preferably the square root of the dielectric constant of the central pane. The improved wave impedance matching provides a low wave reflection over a wide frequency band.

U.S. Pat. No. 3,860,891 entitled "Microwave waveguide window having the same cutoff frequency as adjoining waveguide section for an increased bandwidth" discloses a microwave waveguide window is disclosed wherein a dielectric filled window section of waveguide is sealed across a waveguide. The window filled section of waveguide in one embodiment is dimensioned to have approximately the same low frequency cutoff wavelength as that of the adjoining sections of guide, such that the window and that of the adjoining sections of the waveguide support approximately the same waveguide transmission modes. In certain windows of the present invention, a quarter wave matching transformer portion of the dielectric window extends from the window into the adjacent waveguide sections. In other windows of the present invention, one or both adjoining sections of waveguide have a substantially lower height, such as ridged waveguide, than the dielectric filled window section and a short section of transition waveguide is interposed between the window and the adjoining lower height waveguide with the dielectric window member projecting into the transition section of waveguide.

U.S. Pat. No. 3,710,243 entitled "Microwave gage for monitoring thickness of a conductive workpiece, flaws therein or displacement relative thereto" discloses a microwave induction gage for inspecting a conductive workpiece such as conductive sheet material wherein microwave energy is fed to a gaging head having a conductive plate member coupling microwave energy onto the surface of the workpiece to be inspected. A waveguide window formed by the spacing between the conductive sheet material and a fin secured to said plate member and arranged transverse to the direction of energy propagation in the head area passes microwave energy, the amplitude of which varies as an exponential function of the spacing, whereby detection and measurement of the amplitude of the energy passing the window provides an indication of the magnitude of the spacing. The plate member is grooved to guide energy through the coupler head area. Also, a fin may be fitted longitudinally in the groove to aid mode stability. By employing two of the conductive plate members, one on either side of the workpiece so as to form a pair of spaced energy paths, the amplitude of the energy passing the windows may be detected and multiplied to provide an indication of the thickness of the workpiece with inherent compensation for lateral displacement.

U.S. Pat. No. 3,781,726 entitled "Waveguide window assembly" discloses a waveguide gas pressure window that in a single assembly provides a waveguide window and a pressure seal to gases used as a dielectric, while at the same time providing a low loss transfer of power through the window from a first waveguide section into a second waveguide section. The improved waveguide window includes a plate having the shape of the waveguide flange with a seal material positioned in a groove on both sides of the plate to contact the two waveguide flanges between which the window is mounted. The flat plate has a common flanged opening formed on one side thereof in which a window structure is positioned on shoulders and firmly bonded in position with a suitable retaining material. The window structure is formed of a suitable dielectric material such as a Teflon fiberglass plate having copper sheets deposited on both sides thereof with the copper etched or removed from the fiberglass to provide a window having the desired impedance matching characteristics. The window structure for a selected waveguide size may have a common outside dimension for being positioned in the flat plate while allowing desired electrical and impedance changes to be provided during manufacture by selecting the dimensions of the surface from which copper is removed. The improved and simplified pressure window assembly in accordance with the invention provides complete electrical continuity, eliminates RF energy leakage and simplifies alignment of the adjacent waveguide sections.

U.S. Pat. No. 5,430,257 entitled "Low stress waveguide window/feedthrough assembly" discloses an apparatus for mounting a waveguide window or conduction member into a housing such that a smooth gradient of the coefficient of thermal expansion exists between the housing and the window or conduction member, thereby reducing the internal stress which results from ambient temperature variations. The apparatus comprises a frame member for mounting a feedthrough member into a housing. The frame member includes a buffer section having a plurality of sections, each section having a material which progressively varies the coefficient of thermal expansion. The frame member further includes additional stress relief features and structural elements facilitating manufacture and assembly of the apparatus.

U.S. Pat. No. 5,218,373 entitled "Hermetically sealed waffle-wall configured assembly including sidewall and cover radiating elements and a base-sealed waveguide window" discloses that directed millimeter wave radiation from internal elements of a microwave circuit through the housing cover, housing base, and side walls of a hermetically-sealed MMIC integrated subsystem assembly uses a waffle-wall array of conductive posts as a band rejection filter to provide walls which guide the radiated waves through a hermetically sealed window in the housing base for waveguide propagation or to a dielectric side wall or cover to radiate energy therethrough. For a waveguide launch, the launch probe is printed on a TEM mode microstrip transmission line substrate and is located over or on a dielectric window formed at the end of an air filled waveguide. A waveguide-like mode of propagation is launched perpendicular to the microstrip substrate and the energy its transmitted through the dielectric window into the air dielectric waveguide which extends through the housing base. Side wall mounted antennas use radiating elements placed near the side walls of the subsystem assembly and are surrounded on their remaining sides by the conductive post structure. The launched waves propagate toward the dielectric side wall to radiate outwardly from the subsystem assembly. For radiating energy through the subsystem assembly cover, a launch probe is located under a dielectric aperture in the hermetically-sealed cover.

U.S. Pat. No. 5,175,523 entitled "Adjustable coaxial double-disk fluid cooled waveguide window with mean for preventing window bowing" discloses a gyrotron microwave output window made of a pair of centrally coupled dielectric disks in which the displacement between the windows is tunable by adjusting means external to the waveguide and in which the window central coupling automatically compensates for such adjustments and for coolant pressure changes.

U.S. Pat. No. 4,875,216 entitled "Buried waveguide window regions for improved performance semiconductor lasers and other opto-electronic applications" discloses a window laser having at least one window region with a transparent waveguide layer optically coupled to an active region generating lightwaves. The waveguide layer has a broader guided transverse mode for the lightwaves than the active region and may have a thickness which is greater than the active region a refractive index difference with respect to cladding layers which is less than a refractive index difference between the active region and the cladding layers or both. The waveguide layer may be coupled to the active region via a transition region characterized by a gradual change in the guide mode width of the lightwaves such as from a tapered increase in thickness of the waveguide layer in a direction away from the active region. The preferred method of making window region having these transparent waveguides is impurity induced disordering in which the interfaces between active region and cladding layers is disordered by impurity species to produce the waveguide layer with increased bandgap and a graded transverse refractive index profile. The laser has a high power output beam with reduced far field transverse divergence.

U.S. Pat. No. 4,720,693 entitled "Ridged rectangular waveguide provided with a sealed window" discloses a thin waveguide window having a broad band of operating frequencies is composed of a metallic frame provided with an opening and a leak-tight closure plate of dielectric material. The frame permits a reduction in dimensions of the plate, with the result that any spurious frequencies introduced by the plate are rejected from the operating frequency band. By giving the plate an oblong shape, it is possible to balance its inductive components by means of its capacitive components at the mid-band frequency. A matching transformer formed by the ridges which are more closely spaced in the vicinity of the window than in the remainder of the waveguide permits matching throughout the frequency band.

U.S. Pat. No. 4,556,854 entitled "Microwave window and matching structure" discloses a circular waveguide window between two rectangular waveguides having increased bandwidth and increased power handling capability. It uses particular window and an impedance matching structures whose dimensions are related in a particular way to the dimensions of the rectangular waveguides.

U.S. Pat. No. 4,523,127 entitled "Cyclotron resonance maser amplifier and waveguide window" discloses a cyclotron resonance maser microwave amplifier includes coaxial input and output waveguides. Coupling apparatus for cyclotron resonance maser microwave amplifiers and other microwave power systems is provided for transferring microwave power between first and second waveguides. Geometry permits unwanted modes to be effectively attenuated. The coupling apparatus includes first and second coaxial hollow metallic circularly cylindrical members. The first member forms a first waveguide section. A second waveguide section coaxial therewith is bounded internally by the first member and externally by the second member. The first member has a plurality of apertures for transferring microwave power between the first and second waveguide sections. The apertures are small relative to the radius of the first member and are spaced around the circumference of the first member in a generally symmetrical array. The apertures may be located in a plurality of axially extending grooves arranged in a generally symmetrical array with a helical twist and are substantially filled with dielectric inserts which have a relatively short length and small cross-sectional area. The inserts provide a hermetic seal so that the waveguides may contain different media' as desired. Coolant channels are provided adjacent the apertures to dissipate heat generated in the dielectric inserts.

U.S. Pat. No. 4,352,077 entitled "Ridged waveguide window assembly" discloses a window assembly for ridged waveguide has a slab of dielectric extending clear across the waveguide cross-section. The slab may be perpendicular to the waveguide or cross it at an angle. The waveguide ridge or ridges are notched so that the dielectric slab passes through the notch. Inductive tuning posts may be added to make a broadband match. The window assembly has an excellent match over more than an octave frequency range.

U.S. Pat. No. 4,041,420 entitled "Shunted stepped waveguide transition" discloses a transition device for joining waveguides of different characteristic impedances employs one or more sections that are stepped in height in the manner of a quarter wave transformer. Each of the sections is approximately a quarter wavelength long. A resonant element is situated at the low impedance end of the transition device. The element is resonant at a frequency within the pass band of the transition device. The invention provides improved performance over that obtained with a conventional quarter wave transformer of approximately the same length.

U.S. Pat. No. 3,676,809 entitled "Thin film microwave iris discloses a thin film microwave iris including an aperture, inside a microwave waveguide transverse to the flow of microwave energy in the waveguide with the thin film electrically connected to the walls of the waveguide. Due to the flow of energy through the film as well as through the aperture, the characteristics of thin film irises are different from the characteristics of conventional irises.

U.S. Pat. No. 3,675,165 entitled "Waveguide window for transmission of electromagnetic waves" discloses a window for sealing a waveguide gas pressurized to transmit microwave signals comprising: a dielectric plate permeable to the microwave signals, and a mechanical structure hermetically sealing the dielectric plate in the interior of the waveguide and including four openings dimensioned to provide the window with a substantially flat voltage standing wave ratio versus frequency characteristic over a predetermined frequency range, two relatively movable members to permit the dielectric plate to move to compensate for unequal gas pressures on opposite surfaces thereof, and a space to allow movement of the two members to compensate for thermal expansion thereof due to microwave signal loss in the dielectric plate.

U.S. Pat. No. 3,594,667 entitled "Microwave window having dielectric variations for tuning of resonances" discloses a high-power microwave window structure is disclosed. The window structure includes a hollow waveguide having a dielectric wave permeable gaslight partition sealed thereacross to form the window assembly. The window structure is capable of being impedance matched to the waveguide structure to provide a relatively wide passband. In certain windows the passband can be as wide as the recommended bandwidth for the waveguide itself. Such window structures are plagued by "trapped" and "ghost" resonant modes which are excited into resonance by slight asymmetries in the window structure. At their resonant frequencies, these modes couple energy from the main propagating mode to produce an impedance mismatch and at high-power levels, overheating and failure of the window structure. Thus, operation at high-power levels is typically restricted to frequency ranges between a pair of such resonant modes. The frequency separation between the resonant modes is increased to provide broader band operation by selectively tuning the resonant frequencies of these modes by selectively varying the electrical path length through the window structure for one or more of these modes. For example, the window is made thicker near the periphery where one of the resonant modes has its most intense electric fields and made thinner near the center where another of the modes has its intense electric fields to tune one of the modes higher in frequency, while the other mode is being tuned lower in frequency. The mean thickness of the window is maintained approximately constant such as not to change appreciably the passband for the main propagating mode. Alternatively, the dielectric constant for various portions of the window can be changed for changing the electrical path length through the window.

U.S. Pat. No. 3,593,224 entitled "Microwave tube transformer-window assembly having a window thickness equivalent to one-quarter wavelength and metallic step members to transform impedance" discloses a microwave tube transformer-window is described utilizing a waveguide step transformer with a solid block window one-quarter wavelength long and producing the same impedance as the replaced step.

Therefore, as is evidenced by the complicated devices disclosed in these patents, there is a need for an inexpensive, reliable mechanism that may be used to blank or block the energy path between an antenna and a receiver or transmitter to prevent harmful radiation from adversely affecting the receiver or transmitter. Accordingly, it is an objective of the present invention to provide a printed circuit waveguide switch window that may be used to blank or block the energy path between an antenna and a receiver or transmitter from harmful radiation in the absence of power forms supplied to the receiver or transmitter.

SUMMARY OF THE INVENTION

To accomplish the above and other objectives, the present invention satisfies the need for an inexpensive (<$5.00), reliable mechanism for blanking (blocking) a path between an antenna and a receiver or transmitter to protect the receiver or transmitter from harmful radiation in the absence of power forms supplied thereto. The present invention has been designed for use with missile receivers or transmitters that must be protected from potential radiation damage caused by countermeasures threats, for example.

The present invention comprises a printed circuit waveguide switch window having a plurality of parallel conductors, such as metal wires or printed circuit traces, disposed on one surface of a dielectric substrate, such as a substrate comprising a polyimide, which is available from duPont de Nemours & Co. under the trade name Kapton, for example. The plurality of printed circuit traces have a predetermined separation and width. The separation and width of the printed circuit traces are designed to appear as a solid metal surface which rejects radiation over a wide bandwidth. One printed circuit waveguide switch window is disposed between two sections of waveguide between the antenna and the receiver or transmitter.

A bias terminal is coupled to each of the plurality of printed circuit traces of the printed circuit waveguide switch window. Insulating tape, or other insulating material, is disposed between, or on top of, the bias terminal and the plurality of printed circuit traces adjacent a top portion of the adjacent section of waveguide. The bottom portions of the plurality of printed circuit traces are grounded to the adjacent section of waveguide. When a predetermined voltage or power level is supplied to the bias terminal, it vaporizes the printed circuit traces and opens the waveguide switch window to allow normal operation of the antenna, transmitter and receiver. In particular, at a predetermined time after power forms are supplied to the transmitter or receiver, the bias voltage is supplied to the waveguide switch window and the transmitter or receiver is unblanked and remains in that state.

When the printed circuit waveguide switch window is in its protective, blanked state, it blocks undesired radiation from entering through the antenna and destroying sensitive components in the transmitter or receiver. This is typically required when the transmitter or receiver, or a missile in which they are employed, is in a shipping container, or prior to launch of the missile containing the transmitter or receiver.

The printed circuit waveguide switch window provides a radiation blanking mechanism that does not use unreliable, costly features of currently available state-of-the-art switches having moving parts, semiconductors, and ferrite materials. As has been shown in tests, the printed circuit waveguide switch window provides radiation immunity against high level input radiation power and high isolation (30 dB) for receiver protection in the blanked state, and with no measurable loss in the unblanked state. The printed circuit waveguide switch window may be used with a number of microwave and millimeter wavelength transmitters and receivers used in missiles manufactured by the assignee of the present invention, for example.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
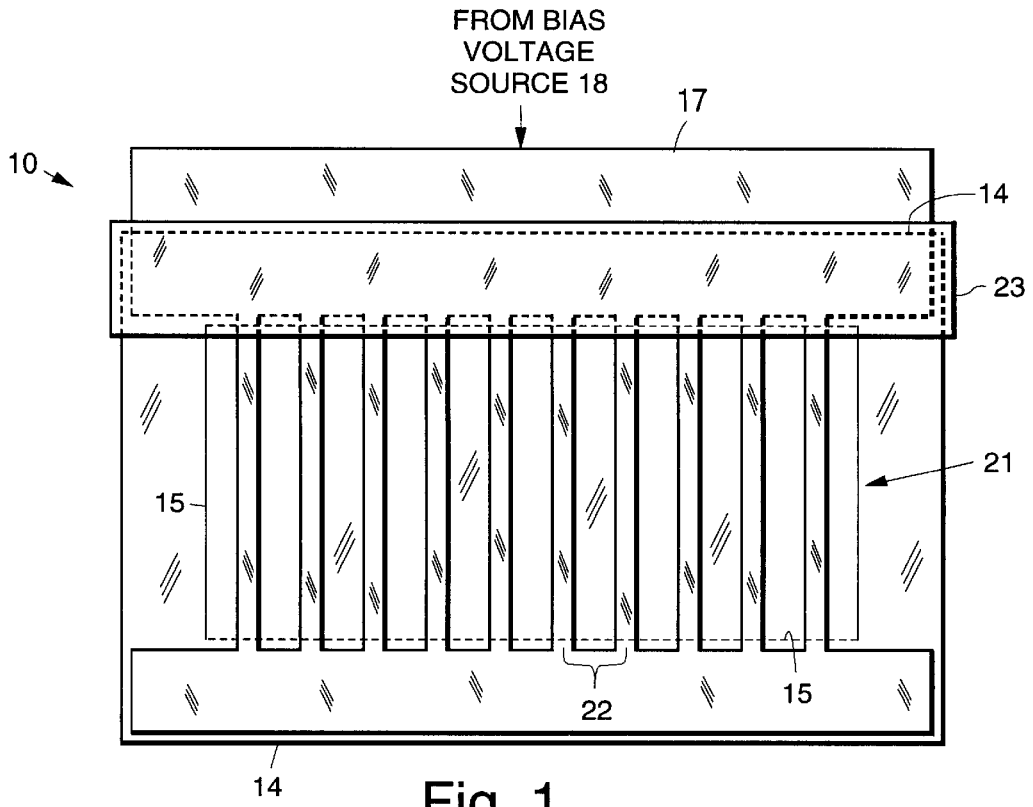
FIG. 1 is a front view of an exemplary printed circuit waveguide switch window in accordance with the principles of the present invention.
Figure 2:
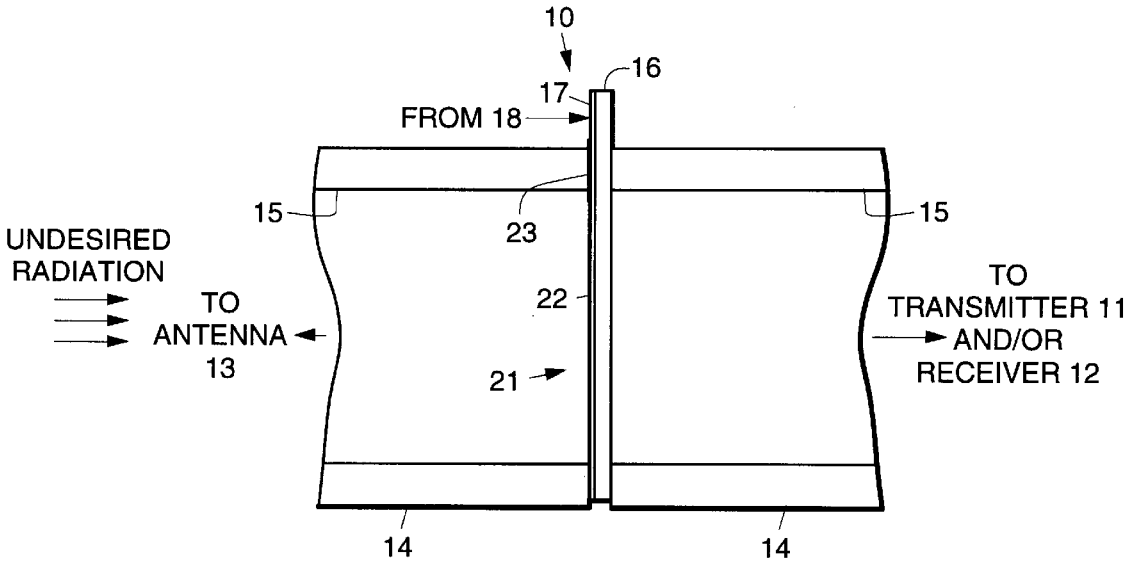
FIG. 2 is a side view of the present printed circuit waveguide switch window disposed between two sections of waveguide.

Referring to the drawing figures, FIG. 1 illustrates a front view of a printed circuit waveguide switch window 10 in accordance with the principles of the present invention. FIG. 2 is a side view of the printed circuit waveguide switch window 10 disposed between two sections of waveguide 14.

The printed circuit waveguide switch window 10 is used in conjunction with radar systems comprising transmitters 11, receivers 12, and antennas 13 (FIG. 2) that operate at microwave or millimeter wavelengths, such as radar systems, transmitters 11, receivers 12, and antennas 13 employed in missiles manufactured by the assignee of the present invention.

The transmitter 11, receiver 12, and antenna 13 are coupled together by sections of waveguide 14 that route signals between the antenna 13 and the transmitter 11 or receiver 12. The sections of waveguide 14 may have internal dimensions on the order 0.050 inches by 0.100 inches, for example, which are dimensions typical of waveguides 11 employed with transmitters 11 and receivers 12 that operate from 75–110 GHz for example. Internal walls 15 of the sections of waveguide 14 are shown for clarity by dashed and solid lines in FIG. 1.

The printed circuit waveguide switch window 10 is formed on a dielectric substrate 16 (FIG. 2), which may be Kapton dielectric material, for example. The printed circuit waveguide switch window 10 has a bias input terminal 17 formed on a top surface of the substrate 16. The bias input terminal 17 is coupled to a bias voltage source 18 in the transmitter 11 or receiver 12. The bias input terminal 17 is coupled to a conductive grid array 21 having a plurality of parallel metal wires 22 or printed circuit traces (steps) 22 formed on the top surface of the substrate 16. Insulating tape 23, or other insulating material 23, is disposed between (or on top of) the bias terminal 17 and the plurality of printed circuit traces 22. The insulating tape 23 is used to insulate the parallel metal wires 22 or printed circuit traces 22 from the upper portion of the waveguide 14. The parallel metal wires 22 or printed circuit traces 22 adjacent the lower portion of the waveguide 14 are grounded to the waveguide 14.

The parallel metal wires 22 or printed circuit traces 22, when constructed with the proper separation and width, typically having a width on the order of 0.002 inches and a center-to-center separation on the order of 0.010 inches for radiation in the 75–110 GHz wavelength range, for example, appear as a solid metal surface over wide bandwidths supported by the waveguide 14. This technique has heretofore been used to lighten antennas and reduce wind loading on the antennas. This principle is used in the present invention to block undesired radiation from entering through the antenna 12 and destroying sensitive components in the receiver 12 or transmitter 11, while it or a missile in which it is disposed is in a shipping container or prior to launch.

Referring again to FIG. 1, it illustrates a photoetched printed circuit waveguide switch window 10 built for a proof-of-principle test of the present invention. The grid array 21 of printed circuit traces 22 of the proof-of-principle waveguide switch window 10 was printed on a 0.001 inch thick Kapton dielectric substrate 16 having 0.00015 inch thick copper printed circuit traces 22 disposed on its top side. By applying a momentary voltage (that supplies approximately 2 joules of energy) to the bias terminal 17, the 0.002 inch by 0.00015 inch grid array 21 of printed circuit traces 22 vaporizes, resulting in a very low loss unblanked switch state. The low loss unblanked switch state allows desired energy that is to be transmitted by the transmitter 11 or received by the receiver 12 to propagate past the waveguide switch window 10 between the antenna and the transmitter 11 or receiver 12.

The test was conducted by sandwiching a 0.001" Kapton window between flanges of two sections of waveguide 14, such as is shown in FIG. 2, and the blanked isolation and unblanked loss were measured in the two switch states. The test data are as follows. The test frequency was 98 GHz, the blanked isolation of the photoetched printed circuit waveguide switch window 10 was 29 dB, and the unblanked loss of the photoetched printed circuit waveguide switch window 10 was less than 0.1 dB.

Thus, a low cost, waveguide switch window that may be used to blank a receiver input from harmful radiation in the absence of power forms has been disclosed. It is to be understood that the described embodiment is merely illustrative of some of the many specific embodiments that represent applications of the principles of the present invention. Clearly, numerous and other arrangements can be readily devised by those skilled in the art without departing from the scope of the invention.

What is claimed is:

1. A waveguide switch window for use with a system comprising an antenna and either a transmitter or a receiver that are respectively coupled together by sections of waveguide, said window comprising:

a dielectric substrate;

a bias input terminal formed on one surface of the substrate that is coupled to a bias voltage source;

a conductive grid array formed on the one surface of the substrate that is coupled to the bias input terminal; and insulating material disposed on the one surface of the substrate between the bias terminal and the conductive grid array;

wherein the waveguide switch window is disposed between the sections of waveguide such that the insulating material insulates an upper portion of the conductive grid array from an adjacent waveguide, and wherein a lower portion of the conductive grid array is grounded to the adjacent waveguide;

and wherein the waveguide switch window normally operates in a blanked state that blocks radiation entering the antenna from passing through the window, and when a predetermined voltage is supplied to the bias terminal, the conductive grid array is vaporized to configure the waveguide switch window in an unblanked state to allow energy to pass between the antenna and the transmitter or receiver.

2. The window of claim 1 wherein the dielectric substrate comprises a polyimide dielectric material.

3. The window of claim 1 wherein the conductive grid array is formed as a printed circuit.

4. The window of claim 1 wherein the conductive grid array comprises a plurality of parallel metal wires.

5. The window of claim 1 wherein the conductive grid array comprises a plurality of printed circuit traces.

6. The window of claim 1 wherein the insulating material comprises insulating tape.

7. The window of claim 1 wherein conductors of the conductive grid array have a separation and width that appear as a solid metal surface over wide bandwidths.

8. The window of claim 1 wherein conductors of the conductive grid array have a width on the order of 0.002 inches and a separation on the order of 0.010 inches which blocks radiation in the 75–110 GHz wavelength range.

9. A window for use with components that are coupled together by sections of waveguide, said window comprising:

a dielectric substrate;

a bias input terminal formed on one surface of the substrate that is coupled to a bias voltage source;

a conductive grid array formed on the one surface of the substrate that is coupled to the bias input terminal; and insulating material disposed on the one surface of the substrate between the bias terminal and the conductive grid array;

wherein the waveguide switch window is disposed between the sections of waveguide such that the insulating material insulates an upper portion of the conductive grid array from an adjacent waveguide, and wherein a lower portion of the conductive grid array is grounded to the adjacent waveguide;

and wherein the waveguide switch window normally operates in a blanked state that blocks radiation from passing through the window, and when a predetermined voltage is supplied to the bias terminal, the grid array is vaporized to configure the waveguide switch window in an unblanked state to allow energy to pass through the window.

10. The window of claim 9 wherein the dielectric substrate comprises a polyimide dielectric material.

11. The window of claim 9 wherein the conductive grid array is formed as a printed circuit.

12. The window of claim 9 wherein the conductive grid array comprises a plurality of parallel metal wires.

13. The window of claim 9 wherein the conductive grid array comprises a plurality of printed circuit traces.

14. The window of claim 9 wherein the insulating material comprises insulating tape.

15. The window of claim 9 wherein conductors of the conductive grid array have a separation and width that appear as a solid metal surface over wide bandwidths.

16. The window of claim 9 wherein conductors of the conductive grid array have a width on the order of 0.002 inches and a separation on the order of 0.010 inches which blocks radiation in the 75–110 GHz wavelength range.

17. A waveguide switch window comprising:

a dielectric substrate;

a bias input terminal formed on one surface of the substrate that is coupled to a bias voltage source;

a conductive grid array formed on the one surface of the substrate that is coupled to the bias input terminal, said conductive grid array comprising a plurality of metal lines; and insulating material disposed on the one surface of the substrate between the vias terminal and the conductive grid array;

wherein the waveguide switch window normally operates in a blanked state that blocks radiation in the 75–110 GHz wavelength range from passing through the window, and when a predetermined voltage is supplied to the bias terminal, the grid array is vaporized to configure the waveguide switch window in an unblanked state to allow energy to pass through the window.

18. The window of claim 17 wherein the dielectric substrate comprises a polyimide dielectric material.

19. The window of claim 17 wherein the conductive grid array is formed as a printed circuit.

20. The window of claim 17 wherein conductors of the conductive grid array have a width on the order of 0.002 inches and a separation on the order or 0.010 inches.

* * * * *